US006297591B1

(12) United States Patent
Roberts

(10) Patent No.: US 6,297,591 B1
(45) Date of Patent: Oct. 2, 2001

(54) CHIMNEY-COOLED ARC LAMP ELECTRODE

(75) Inventor: Roy D. Roberts, Hayward, CA (US)

(73) Assignee: ILC Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/196,432

(22) Filed: Nov. 19, 1998

(51) Int. Cl.[7] ..... H01J 17/04; H01J 61/04; H01J 1/02; H01J 61/52; H01J 7/24

(52) U.S. Cl. ..... 313/631; 313/484; 313/632; 313/492; 313/110; 313/113; 313/30; 313/35; 315/169.1; 315/246

(58) Field of Search ..... 313/11, 12, 13, 313/17–19, 21–28, 30, 32–33, 34–36, 39, 42, 46, 47, 484, 483, 491–93, 573–74, 631–632, 634–635, 110, 113, 618, 623; 315/169.1, 246, 167, 179

(56) References Cited

U.S. PATENT DOCUMENTS 3,723,782 * 3/1973 Thomsen ..... 313/30
3,723,783 * 3/1973 Beese et al. ..... 313/32
4,633,128 12/1986 Roberts et al. ..... 313/113
4,785,216 * 11/1988 Roberts et al. ..... 313/32
5,399,931 * 3/1995 Roberts ..... 313/46
5,633,556 * 5/1997 Fujina et al. ..... 313/32

* cited by examiner

*Primary Examiner*—Nimeshkumar D. Patel
*Assistant Examiner*—Mack Haynes
(74) *Attorney, Agent, or Firm*—Thomas E. Schatzel; Law Offices of Thomas E. Schatzel, a Prof. Corp.

(57) ABSTRACT

An arc lamp comprising a hollowed-anode electrode with an arc-face having a central hole extending to an internal chimney. An opposing cathode electrode faces the hollowed anode electrode for providing a short electric arc around the central hole in the arc-face of the hollowed anode electrode. The anode and cathode electrodes are disposed in an inert gas, such as xenon. The internal gas is subject to an "arc wind" for transporting metal deposits downstream of the short electric arc and flowing from the short electric arc down the chimney. Such operation provides for an improvement in arc lamp life because the reflector blackens far less rapidly. A magnetic z-pinch pumping mode can be used to move the arc wind away from the reflector.

7 Claims, 1 Drawing Sheet

CHIMNEY-COOLED ARC LAMP ELECTRODE

BACKGROUND OF THE INVENTION

1. Field of the Invention

Figure 1:
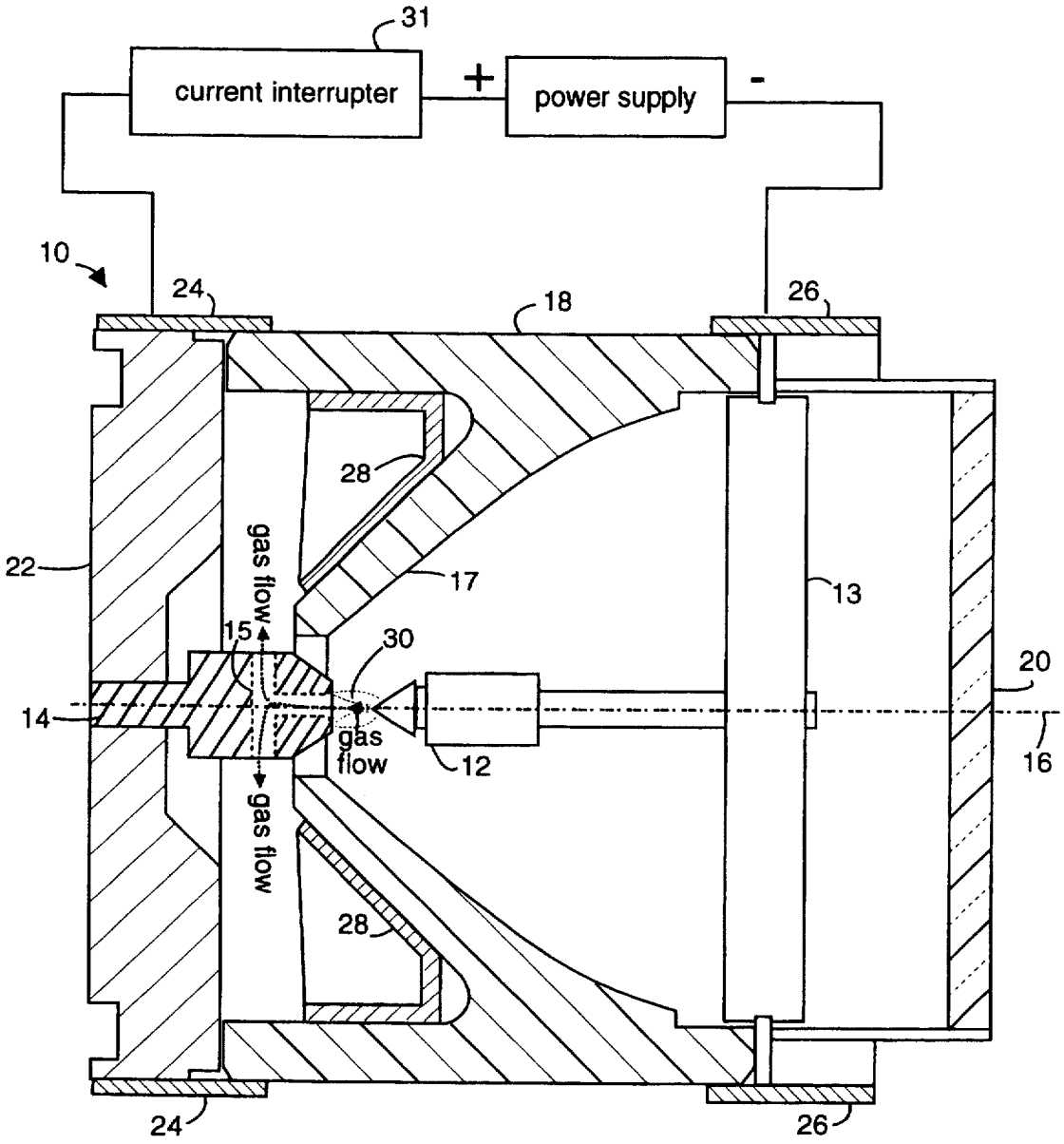

The invention relates generally to arc lamps and specifically to devices and methods used to cool the anode electrode of arc lamps.

2. Description of the Prior Art

Short arc lamps provide intense point sources of light that allow light collection in reflectors for applications in medical endoscopes, instrumentation and projection. Also, short arc lamps are used in industrial endoscopes, for example in the inspection of jet engine interiors.

A typical short arc lamp comprises an anode and a cathode positioned along the longitudinal axis of a cylindrical, sealed concave chamber that contains a gas pressurized to several atmospheres. U.S. Pat. 4,633,128, issued Dec. 30, 1986, to Roy D. Roberts, the present inventor, and Robert L. Miner, describes such a short arc lamp in which a copper sleeve member is attached to the reflecting wall to conduct heat from the reflecting wall through to the exterior wall and eventually to circulating ambient air.

The lamp illustrated in FIG. 2 of Roberts, et al., can be operated at one kilowatt. At higher power levels, the heat generated by an electric arc between cathode 42 and anode 44 encounters thermal resistance to the ambient which may result in overheating and potential failure. Specifically, applying too much power to the lamp creates thermal gradients in the ceramic material that may cause cracks in the body and possibly an explosion of a weakened lamp.

Conventional short arc lamps have solid anodes that tend to get very hot at the center of the face supporting the arc. A portion of the electrode metal usually vaporizes and then deposits on the reflector. These deposits blacken the reflector and cause increased heat absorption. As a result, lamp life is seriously curtailed by such deposits.

SUMMARY OF THE PRESENT INVENTION

It is therefore an object of the present invention to provide an arc lamp with electrodes that operate at cooler temperatures and therefore improve lamp life.

Briefly, an arc lamp embodiment of the present invention comprises a hollowed-anode electrode with an arc-face having a central hole in it connected to an internal chimney. An opposing cathode electrode is set facing the hollowed anode electrode and provides for a short electric arc all around the central hole in the arc-face of the hollowed anode electrode. The anode and cathode electrodes are disposed in an inert gas, such as xenon. The internal gas is subject to an "arc wind" that can transport metal deposits downstream of the short electric arc. Critically, such arc wind is made to flow from the short electric arc down the chimney. Such operation provides for an improvement in arc lamp life because the reflector blackens far less rapidly.

An advantage of the present invention is that a lamp is provided with a much longer life than conventional designs.

These and other objects and advantages of the present invention will no doubt become obvious to those of ordinary skill in the art after having read the following detailed description of the preferred embodiment which is illustrated in the drawing figure.

IN THE DRAWINGS

FIG. 1 is a cross-sectional view of a cylindrical-shaped, high-intensity short arc lamp embodiment of the present invention.

DETAILED DESCRIPTION OF THE PREFERRED EMBODIMENT

FIG. 1 illustrates a art short arc lamp embodiment of the present invention, referred to herein by the general reference numeral 10. The lamp 10 comprises a cathode 12, a cathode suspension strut 13, and an anode 14.

A distinctive feature of the present invention is a chimney 15 that is hollowed out from the anode 14 on a central lamp axis 16. The center of the face of the anode 14 tends to get the hottest during operation in prior art lamps. Therefore, lamps of the present invention provide a flow area, for example a core passage in this area which in turn forces the arc into a wider plasma spray. The chimney 15 has side ports that allow a through flow of gases that assist in cooling the anode, especially near the arc. Such flowing gases, e.g., xenon, neon, argon, etc., give up such heat when they circulate near cooler surfaces near the outside edges.

The lamp 10 further conventionally includes a reflecting concave wall 17 in a ceramic alumina body 18, a window 20, a metallic base 22, a first metal band 24, a second metal band 26 and a copper heat-transfer pad 28. In operation, an electric arc 30 bridges the gap between cathode 12 and anode 14. Base 22 is typically comprised of iron and functions to electrically connect anode 14 to first metal band 24.

Heat generated by electric arc 30 is conducted away by passing through body 18, especially reflector wall 17 near anode 14 to copper heat-transfer pad 28 and again through body 18 to first metal band 24. An air fin heat sink, not shown, may be mounted over and tightly around first metal band 24 to provide heat sinking to circulating forced air. A second heat path is through anode 14 and rear of base 22 and to first metal band 24.

The chimney 15 receives the "arc wind" that is commonly generated in short arc lamps. Such arc wind is a flow of metal and gas ions generated in a plasma, and would otherwise carry deposits of electrode material, principally tungsten, to the reflector wall 17 and blacken it. A blackened reflector will, in turn, absorb more heat than usual and this leads to a rapid degradation of the lamp's life as the reflector deposits grow in intensity.

In an alternative embodiment of the present invention, the arc 30 is rapidly pulsed by a current interrupter 31. The hollow cone shape of the arc 30 in the lamp 10 creates a momentary magnetic z-pinch that will tend to pump gas in one direction through the chimney 15 in short puffs. The pumping effect can be controlled by the pulse repetition rate and current of the arc 30. Other pumping mechanisms can be used to pull the arc wind down the chimney 15 so that any vaporized electrode material will preferably deposit away from the reflector wall 17.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A gas-filled arc lamp, comprising:

a hollowed-anode electrode with an arc-face having a central hole extending to an internally disposed chimney;

an opposing cathode electrode facing the hollowed anode electrode for providing during operation a short electric arc all around said central hole in said arc-face of the hollowed anode electrode; and an inert gas in which the anode and cathode electrodes are disposed, and further providing for an arc wind to transport away any metal ions generated within said short electric arc;

wherein, during operation said arc wind flows down said chimney away from said short electric arc and increases arc lamp life.

2. The lamp of claim 1, further comprising:

a gas pumping mechanism for forcing said arc wind to flow through said internal chimney.

3. The lamp of claim 2, wherein:

the gas pumping mechanism comprises a magnetic z-pinch mechanism energized by pulsing electricity to said short electric arc during operation.

4. The lamp of claim 1, further comprising:

an internal reflector disposed within the inert gas and surrounding the general area of said short electric arc during operation and further disposed upstream of said arc wind to avoid receiving any electrode-metal deposits.

5. The lamp of claim 1, further comprising:

a gas pumping mechanism for forcing said arc wind to flow through said internal chimney; and an internal reflector disposed within the inert gas and surrounding the general area of said short electric arc during operation and further disposed upstream of said arc wind to avoid receiving any electrode-metal deposits.

6. A gas-filled arc lamp, comprising:

a hollowed-anode electrode with an arc-face having a central hole extending to an internal chimney;

an opposing cathode electrode facing the hollowed anode electrode for providing during operation a short electric arc all around said central hole in said arc-face of the hollowed anode electrode;

an inert gas in which the anode and cathode electrodes are disposed and subject to an arc wind that can transport metal deposits generated in said short electric arc;

a pumping mechanism for forcing said arc wind to flow through said internal chimney, and which comprises a magnetic z-pinch mechanism energized by pulsing electricity to said short electric arc during operation; and an internal reflector disposed within the inert gas and surrounding the general area of said short electric arc during operation and its upstream of said arc wind so as not to receive electrode-metal deposits;

wherein, said arc wind from said short electric arc flows down said chimney away from said short electric arc during operation and provides for an improvement in arc lamp life.

7. A method for prolonging the service life of a short electric arc lamp that includes a cathode and anode electrode disposed in an inert gas and surrounded by an integral reflector subject to blacking by material liberated by an arc between the electrodes, the method comprising:

venting at least one of a working pair of cathode and anode electrodes coaxially from an arc area between;

directing a liberated material from said arc area in a direction away from an integral reflector that radially surrounds said arc area; and pumping said liberated material to force a gas flow through a central vent in at least one of a working pair of cathode and anode electrodes.

* * * * *